US011213069B2

(12) United States Patent
Marshall et al.

(10) Patent No.: US 11,213,069 B2
(45) Date of Patent: Jan. 4, 2022

(54) CIGAR PIERCER

(71) Applicants: Jana Jones Marshall, Owens Cross Roads, AL (US); Samuel Lee Andrew Marshall, Owens Cross Roads, AL (US)

(72) Inventors: Robert William Marshall, Owens Cross Roads, AL (US); Samuel Lee Andrew Marshall, Owens Cross Roads, AL (US)

( * ) Notice: Subject to any disclaimer, the term of this patent is extended or adjusted under 35 U.S.C. 154(b) by 99 days.

(21) Appl. No.: 16/424,215

(22) Filed: May 28, 2019

(65) Prior Publication Data

US 2020/0375247 A1 Dec. 3, 2020

(51) Int. Cl.
*A24F 13/26* (2006.01)

(52) U.S. Cl.
CPC ..... *A24F 13/26* (2013.01)

(58) Field of Classification Search
CPC ..... A24F 13/24; A24F 13/26
See application file for complete search history.

(56) References Cited

U.S. PATENT DOCUMENTS 519,332 A 5/1894 Hopkins
744,893 A 11/1903 Bailey
2,759,260 A 8/1956 Wisniewski
3,405,718 A * 10/1968 Grassi ..... A24F 13/26 131/329
D283,451 S 4/1986 Kolpin
5,799,662 A 9/1998 Conte
5,992,022 A 11/1999 Moya
6,062,227 A 5/2000 Kuenzel
6,708,409 B2 3/2004 Yu
6,889,579 B1 5/2005 Brown
8,720,449 B2 5/2014 Dipple
2003/0110639 A1* 6/2003 Zimmerman, III ..... A24F 13/26 30/109
2012/0247493 A1 10/2012 Jones

OTHER PUBLICATIONS

Lubinski Gold cigar cutter based circular Pentagram shaped Tobacco Cutting Cigar scissors blades Cigar Accessories LB-201, https://www.aliexpress.com/item/32803369519.html, as printed Aug. 9, 2019.

* cited by examiner

*Primary Examiner* — Eric Yaary
(74) *Attorney, Agent, or Firm* — Hitchcock Evert LLP

(57) ABSTRACT

The invention relates to cigar piercers having multiple lances for piercing a cigar. The cigar piercers include an opening for the cigar, grips that are operable to push the lances into the cigar and leave puncture holes after retracting from the cigar.

12 Claims, 13 Drawing Sheets

CIGAR PIERCER

FIELD OF THE DISCLOSURE

The invention relates generally to the fields of cigar accessories and piercing tools for cigars and similar items.

BACKGROUND

Fine cigars are often rolled with cured tobacco leaves. They often include a closed cap covering the head of the cigar. The process for making the capped cigar head creates a sealed end that does not allow sufficient airflow. To enjoy a cigar, a person typically must cut or pierce the head of the cigar to allow airflow into the person's mouth.

People have used various methods to open the head of the cigar for smoking, including biting off the cap, cutting it off or piercing a hole in the cap. Biting inherently creates inconsistent results and may damage the cigar. As such, cutting and piercing tools have been used.

Guillotine cutters, such as the cutter disclosed in U.S. Pat. Nos. 6,708,409 and 519,332, include a blade that passes across a hole designed for a cigar head. When the cigar head is in the hole, a user can squeeze the device to move the blade and cut off the cigar's cap. Because cigars come in a variety of shapes and sized, the hole in these guillotine cutters allows for a user to move the cigar to a selected depth for cutting. If the cut is too far up the cigar, such as on the shoulder or into the barrel, the cigar may come apart or the filler may come out, causing an unpleasant smoking experience or leading to undesired burning characteristics.

Other blade-based cutters have been used to cut cigars. Like guillotine cutters, these bladed devices often allow for cuts that damage the cigar or cause filler to come free and enter the user's mouth on inhalation. Some inventors, such as those in U.S. Pat. No. 2,759,260, have attempted to create bladed devices having a set depth for the cigar to be cut; however, these devices are only useable for certain cigar types that have consistent features, such as the cigar's ring size and head shape.

Cigar punches are designed to cut a plug from the cigar's head. U.S. Pat. No. 5,799,662 discloses an example cigar punch. A user punctures the head with a tube, then rotates the tube and removes, it pulling a cylindrical plug from the cigar. But the process of puncturing and removing the plug can cause damage to the cigar. For example, the plug may pull some filler as it is removed, creating an uneven structure in the cigar and resulting in inconsistent flavor and the potential for loose filler to flow into the smoker's mouth. Like bladed devices, cigar punches may not include any component to manage the depth or may only be suited for certain cigar types.

Cigar piercers or lances cut a hole in the cigar's head like the cigar punches. U.S. Pat. No. 1,734,620 teaches a cigar piercer used to puncture the head of a cigar. These devices typically create direct airflow through the cigar that allows hot inhaled smoke to be drawn onto the smoker's tongue. This can create an unpleasant experience due to excess heat on the tongue, a loss in flavor and/or a shortened smoking period.

SUMMARY

The present disclosure teaches cigar piercers that create multiple perforations around a cigar's ring or perimeter near the head. The perforations may be located in the shoulder or cap of the cigar. The multiple perforations around the cigar's ring allow the draw to disperse in multiple directions into the mouth, providing a cooler inhalation and smoother finish.

Some embodiments are directed to a finger-operated piercer that includes a housing with a hole for a cigar head. The hole may be tailored for a specific cigar style or shape or designed to fit multiple cigar designs.

The piercer may have two movable structures with each structure having a handle with a finger hole on one side and a set of lances or needles on the opposite side of the structure. The set of lances are directed point first toward the hole. When the handles are squeezed, both movable structures move the lances toward each other. In some embodiments, a spring is attached to the movable structure and the housing, which biases the movable structures into a first position. A user must overcome the spring's tension to adjust the movable structure to the second position.

Lance shapes and designs may vary in some embodiments. For example, the lances may be cone-shaped with a rounded cross-section or pyramid-shaped having a polygonal cross-section. In some embodiments, the lances on the movable structure are aligned. In other embodiments, lances may be offset along the movable structure.

Some embodiments of a device include a frame, which holds multiple lances distributed in an arrangement around the opening or hole that is within the housing. The device has two movable structures with handles on opposite sides of the housing. Each movable structure is attached to one end of a movable component, such as a ribbon, while the second end is fixed to the housing. The ribbon passes behind one or more lances and engages the back of these lances. When the handles are squeezed together, each ribbon tightens against the back of the corresponding lances, moving the lances toward the central area of the hole. When the handles move away from each other, the ribbons loosen, allowing the lances to retract into the frame and out of the hole.

In some embodiments, the movable structures are biased to a default first position. The device maintains the first position for both movable structures until a sufficient force moves the structures to a second position.

Some embodiments of the cigar piercer incorporate rotatable rings or discs. The design may include two rings with one configured to rotate relative to the other ring. The stable ring may include a frame with multiple lances having points directed towards a center of the piercer.

In some embodiments, the rotating ring includes a wheel with multiple ramp sections corresponding to the number of lances in the stable ring. As the rotating ring moves, the ramp sections push the lances through the frame toward the center.

Some embodiments include a tube attached to the center frame holding the lances and a rotating ring rotatably connected to the frame. As the ring rotates, ramp sections push lances toward the center. In some embodiments, the tube may be a trough or a combination. The tube or trough may be used to hole the cigar supported in place during use.

In each embodiment, the lances are designed to pierce around the ring of a cigar in the shoulder or head portion. During use, a person will place the head of a cigar in the hole at a desired depth. Then the person will squeeze or rotate the active piece, causing the lances to pierce the cigar, creating a path for a user to draw smoke from without harming the cigar. This also allows the smoother smoking experience by directing the heated airflow in multiple directions and limiting the likelihood of burning or causing an unpleasant airflow on the tongue.

Some embodiments include one ring inside another ring. The inner ring includes lance guides that direct the lance's path inward and guide a spring connected to the lance. While lances may be solid, in some embodiments, they may be caps covering a portion of the spring. The opposite side of the spring is connected to a tab protruding inward from the outer ring. When the outer ring turns one direction relative to the inner ring, the springs move the lances inward to pierce a cigar's ring. When the outer ring is turned the opposite way, the springs pull the lances outward from the cigar. In some embodiments, the guides includes a channel or indented section and the lances include a protrusion near the top. The protrusion corresponds with the channel and allows the lances to move between a first and second position, without coming out of the guides.

In some embodiments, the lance's tip may be rounded to reduce the likelihood of accidentally piercing a person's skin or other undesired item.

In some embodiments, the number of lances may be configured to allow a user to apply multiple puncture designs depending on their own preferences. For example, a piercer with three lances may be used twice to create six punctures in the cigar.

Additional aspects, advantages and features are included in the following description of exemplary examples thereof, which description should be taken in conjunction with the accompanying figures, wherein like numerals are used to describe the same feature throughout the figures. All patents, patent applications, articles and other publications referenced herein are hereby incorporated herein in their entirety for all purposes.

A BRIEF DESCRIPTION OF THE DRAWINGS

Embodiments will now be described, by way of example only, with references to the accompanying drawings in which.

DETAILED DESCRIPTION

While this invention may be embodied in many different forms, there will herein be described in detail preferred embodiments of the invention with the understanding that the present disclosure is to be considered as an exemplification of the principles of the invention and is not intended to limit the broad aspects of the invention to the embodiments illustrated. It will be understood that the invention may be embodied in other specific forms without departing from the spirit or central characteristics thereof. The present embodiments, therefore, are to be considered in all respects as illustrative and not restrictive, and the invention is not to be limited to the details given herein.

Figure 1:
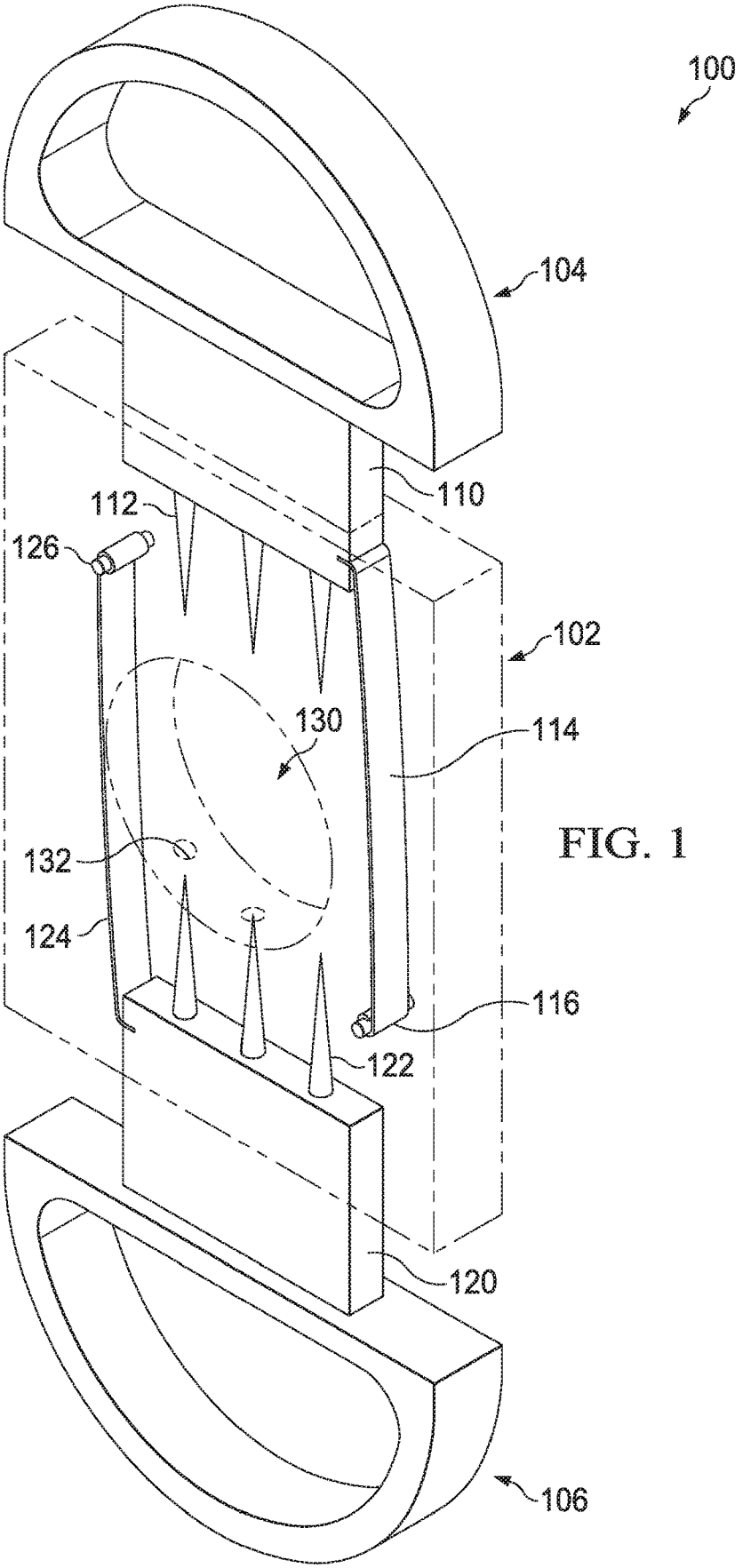
FIG. 1 shows a perspective view of a cigar piercer embodiment with a shadow housing in an open position.
Figure 2:
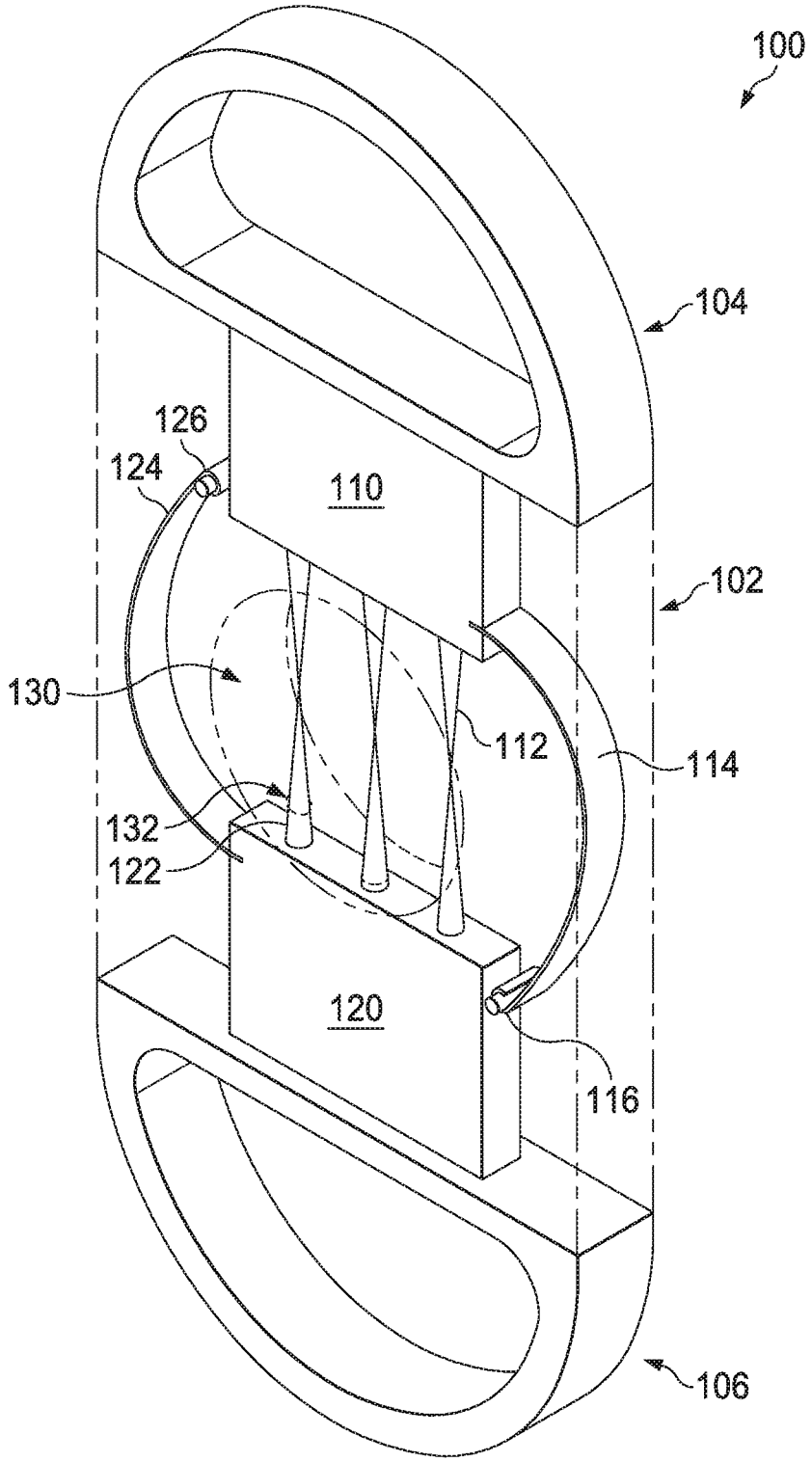
FIG. 2 shows a perspective view of the cigar piercer embodiment with a shadow housing in a closed position.

FIGS. 1 and 2 illustrate an embodiment of a cigar piercer 100. FIG. 1 shows the cigar piercer 100 in an open, disengaged position, and FIG. 2 shows it in a closed, engaged position.

The cigar piercer 100 has a housing 102, first grip 104 and second grip 106. The housing 102 is shown as an outlined structure to distinguish from internal components. The first and second grips 104, 106 are shown in an open position and are configured to press towards the housing 102 to a closed position.

The first grip 104 is designed to fit one or more fingers, which can press the grip inward. While a grip design is shown, the configuration may change for specific design purposes and aesthetics without altering the invention.

The first grip 104 includes a frame 110 that passes through the surface of housing 102. This embodiment includes three lances 112 attached to the end of frame 110. Other embodiments may include more or less lances 112. For example, an embodiment may include two lances. In addition, the lance 112 designs may vary in shape, size, placement and configuration. The illustrated lances 112 have a conical shape forming a pointed tip. In other embodiments, the tip may be rounded or blunt. In addition, the lances 112 may be in the form of a pyramid having a polygonal cross-section. The length of lances 112 may also vary. For example, the lances 112 may be configured to extend only a limited depth into the cigar.

In some embodiments, one or more lances 112 may be different heights. For example, the center lance 112 may be longer than the side lances 112. In addition, the lances 112 may be spaced closer together in some embodiments to ensure that the lances 112 are unlikely to tear the outside wrapping of the cigar, but will pierce into the filler section.

This embodiment also includes a resilient member 114. One end of the resilient member 114 is attached to the frame 110, and an opposite end of the resilient member 114 is attached to post 116, which is fixed to housing 102. The resilient member 114 may be attached to the frame 110 and the post 116 through a variety of connection mechanisms. In this embodiment, the end of the resilient member 114 is shown engaged with a slot in the frame 110, and the opposite end is wrapped around the post 116. In other embodiments, one or both ends may be attached by welded connections, compression fitted connections, adhesive connections, fitted connections or other connections.

The second grip 106 is on the opposite side of housing 102. In this embodiment, the second grip 106 includes elements corresponding to the first grip 104, including the frame 120 and lances 122. In addition, it connects to resilient member 124, which connects to post 126.

The front of housing 102 shows opening 130, which passes through the housing 102. In this embodiment, the opening 130 is a circular shape. The opening 130 may be any rounded shape or polygonal shape. Some embodiments of the cigar piercer 100 may include openings configured for specific cigar shapes and sizes. For example, an opening 130 may be square for a box-pressed cigar. An opening may be more elliptical for a hand-rolled torpedo-shaped cigar. Other cigar piercer 100 designs may be designed to fit multiple cigar shapes and sizes.

The sides of the opening 130 include a series of apertures 132 corresponding to the lances 112 and 122. Along with the lances 112 and 122, the apertures 132 may vary. For example, the cigar piercer 100 may include one upper lance 112 and two lower lances 122 that are octagonal pyramids with rounded tips, and the opening 130 may include one top and two bottom octagonal apertures 132, through which the lances 112 and 122 may pass. In addition, the number and distribution of lances 112 and 122 on the first frame 110 and second frame 120 may vary.

As illustrated in FIG. 2, when the first and second grips 104, 106 are pressed together, the lances 112 and 122 enter the apertures 132 in the opening 130, during which, the resilient members 114 and 124 flex outward within the housing 102.

During use, a person will hold the cigar piercer 100 with a cigar in the opening 130 to the person's desired depth. For example, the person may hold the cigar piercer 100 at the cigar's shoulder. The person may then squeeze the first and second grip 104, 106 causing the lances 112 and 122 to engage and pierce the cigar's shoulder. The user will then relax their grip, which will allow the resilient members 114 and 124 to return to the first position, opening the cigar piercer 100 and withdrawing the lances 112 and 122 from the cigar. If the person wants more punctures, they may rotate the cigar or cigar piercer 100 and repeat the piercing process. A user may repeat the process as desired to create the preferred number of punctures.

In some embodiments, the user may control the puncture depth of the lances 112 and 122. Embodiments may also include a depth control to allow a user to modify the lance depth mechanically. For example, the lances may be mechanically retractable using a threaded control. For another example, the first and second grip 104, 106 may include a depth stop, such as a movable pin or block that may limit the depth of lances 112 and 122.

Figure 3:
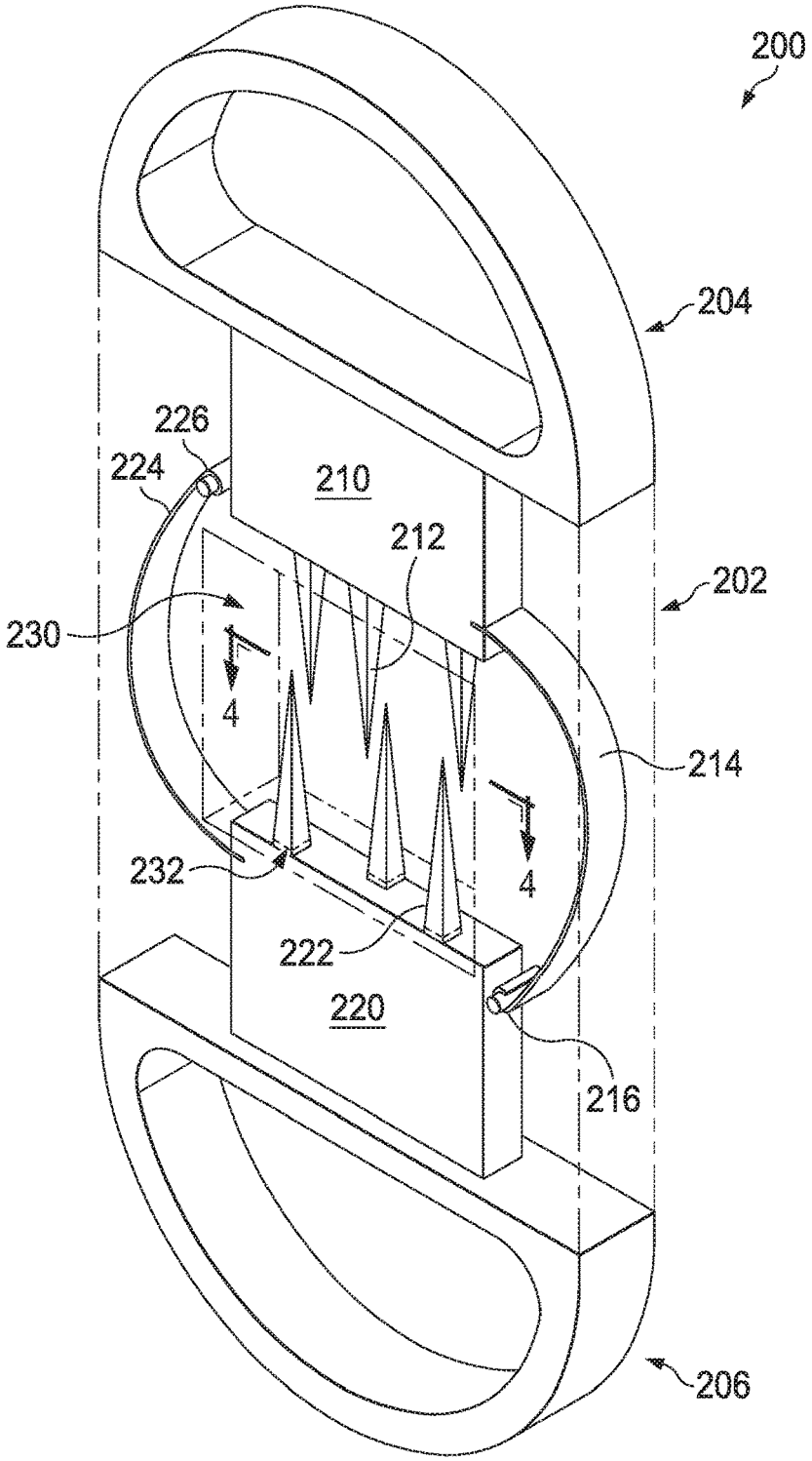
FIG. 3 shows a perspective view of another cigar piercer embodiment with a shadow housing in a closed position.

FIG. 3 illustrates cigar piercer 200, which is similar to cigar piercer 100, in a closed, engaged position. Cigar piercer 200 includes a housing 202 with first grip 204 and second grip 206. The first and second grip 204, 206 include frames 210 and 220, which are connected to resilient members 214 and 224, which are in-turn connected to posts 216 and 226.

The frames 210 and 220 include a series of lances 212 and 222. In this embodiment, the lances 212 and 222 are pyramid shapes. The pyramid-shaped lances 212 and 222 may create different types of protrusions in a cigar than a conical-shaped lance. For example, the corners of the pyramid-shaped lances 212 and 222 may allow the lances to cut the cigar wrapper in a manner that prevents resilient materials in the cigar from closing the punctures created by the lances, thereby creating clean, open punctures in the wrapper. Embodiments may include lances 212 and 222 that are configured for certain cigar materials and smoking preferences.

Figure 4:
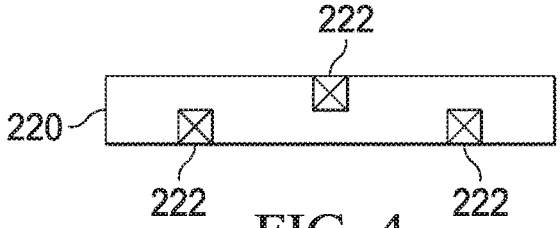
FIG. 4 shows a top view of the bottom set of lances from the cigar piercer embodiment as shown in FIG. 3.

The lances 212 and 222 are also arranged in an offset pattern distributed on frames 210 and 220. FIG. 4 illustrates a top view of the lances 222 on the frame 220. This view illustrates the offset arrangement of lances 222 along the frame 220. This embodiment, includes two lances 222 in the front and one lance 222 in the back. The corresponding upper lances 212 are shown with inverted positions—one in front and two in back—in FIG. 3. This offset pattern results in punctures that are sufficiently spaced to limit any structural damage to the cigar.

The lances 212 and 222 may be configured in any pattern. For example, the upper lances 212 may be offset in the front while lower lances 222 are offset in the back. In some embodiments, the offset pattern may be designed to reduce the likelihood of damaging the cigar. For instance, the outer lances 212 and 222 may be offset from each other and the edge of the cigar to reduce the likelihood that the outer lances 212 and 222 cut or tear an edge of the external wrapper.

Cigar piercer 200 also includes an opening 230 with apertures 232 in the housing 202. In this embodiment, the opening 230 is a rectangular shape. Such a design may be configured to fit box-pressed cigars. The apertures 232 are also rectangular to correspond with the pyramid-shaped lances 212 and 222.

Cigar piercer 200 operates like cigar piercer 100. A user holds the cigar piercer 200 at a desired depth at the head of the cigar, such as just below the shoulder, and squeezes the first and second grips 204 and 206. As the user squeezes grips 204 and 206, the lances 212 and 222 are pressed into the cigar, puncturing the wrapper. When the user stops applying pressure, the resilient members 214 and 224 push the grips 204 and 206 apart, causing the lances 212 and 222 to exit the cigar. The user may then reset the cigar piercer 200 and turn the cigar 90 degrees if the user would like to add additional punctures to the other sides of the cigar.

Some embodiments of cigar piercer 200 may include alignment features configured to engage the exterior of the cigar to align it in place prior to piercing. In some embodiments, the alignment features may also hold the cigar in place during the piercing process. As an example, frame 220 may include sliding plates that have angled sides forming a "V"-like shape with the point aligned near the center of opening 230 along a vertical axis. Similarly frame 210 may include sliding plates forming an aligned inverted "V"-like shape. These plates' bases have a slideable connection with the frames 210 and 220. This slideable connection may include a low-force spring configured to bias the plates ahead of the lances 212 and 222, while allowing the plates to slide without harming the cigar. As the grips 204 and 206 are squeezed, the corresponding sliding plates move into the opening 230 ahead of the lances 212 and 222. When the sliding plates engage a cigar, the cigar will move to contact all four plates, thereby aligning and centering the cigar within the opening 230. As the grips 204 and 206 continue to move inward, the plates each remain in this engaged position with the bases of these plates sliding with respect to the frames 210 and 220. One skilled in the art will recognize that alignment features may be applied to other embodiments, and other alignment features may be implemented.

Figure 5:
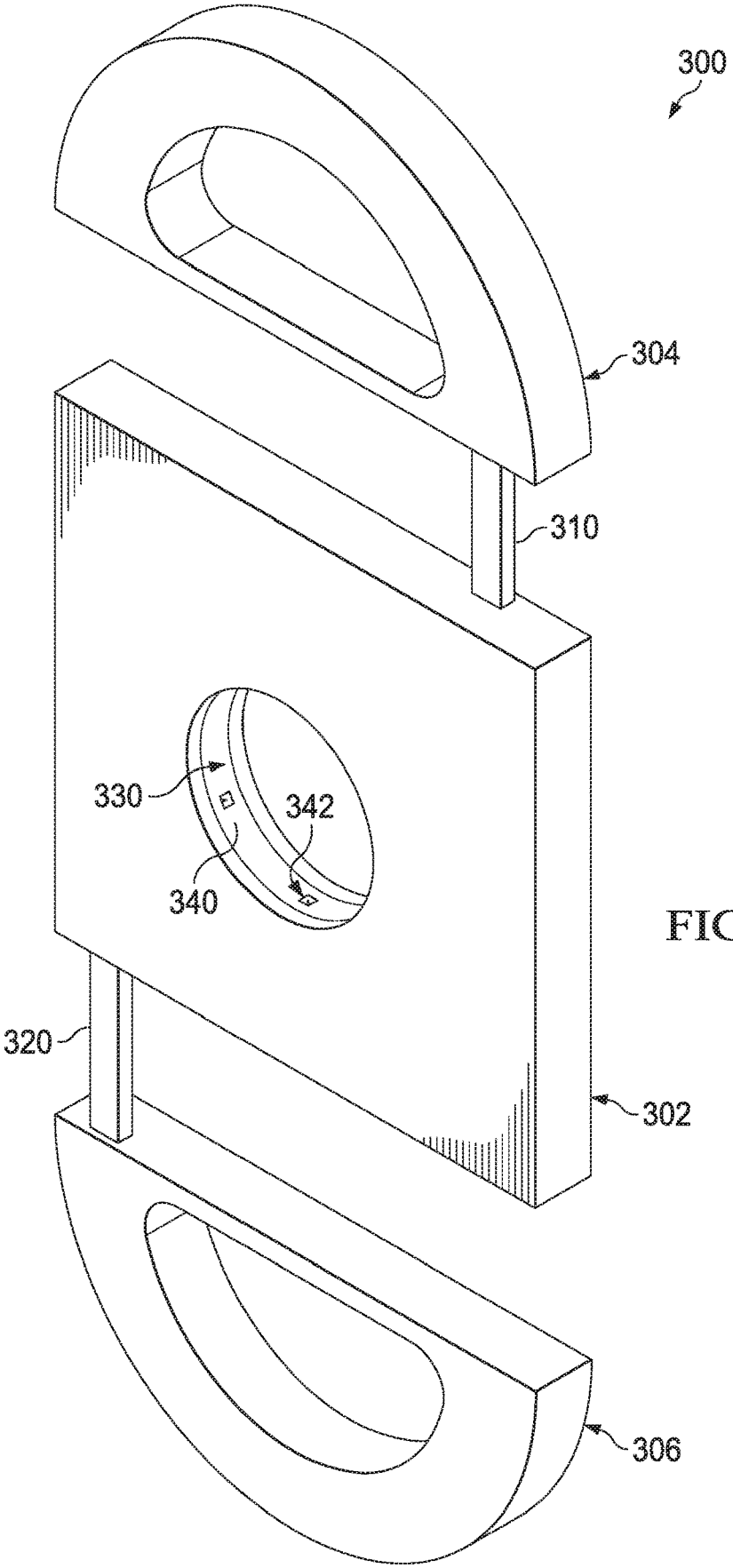
FIG. 5 shows a perspective view of another cigar piercer embodiment in an open position.
Figure 6:
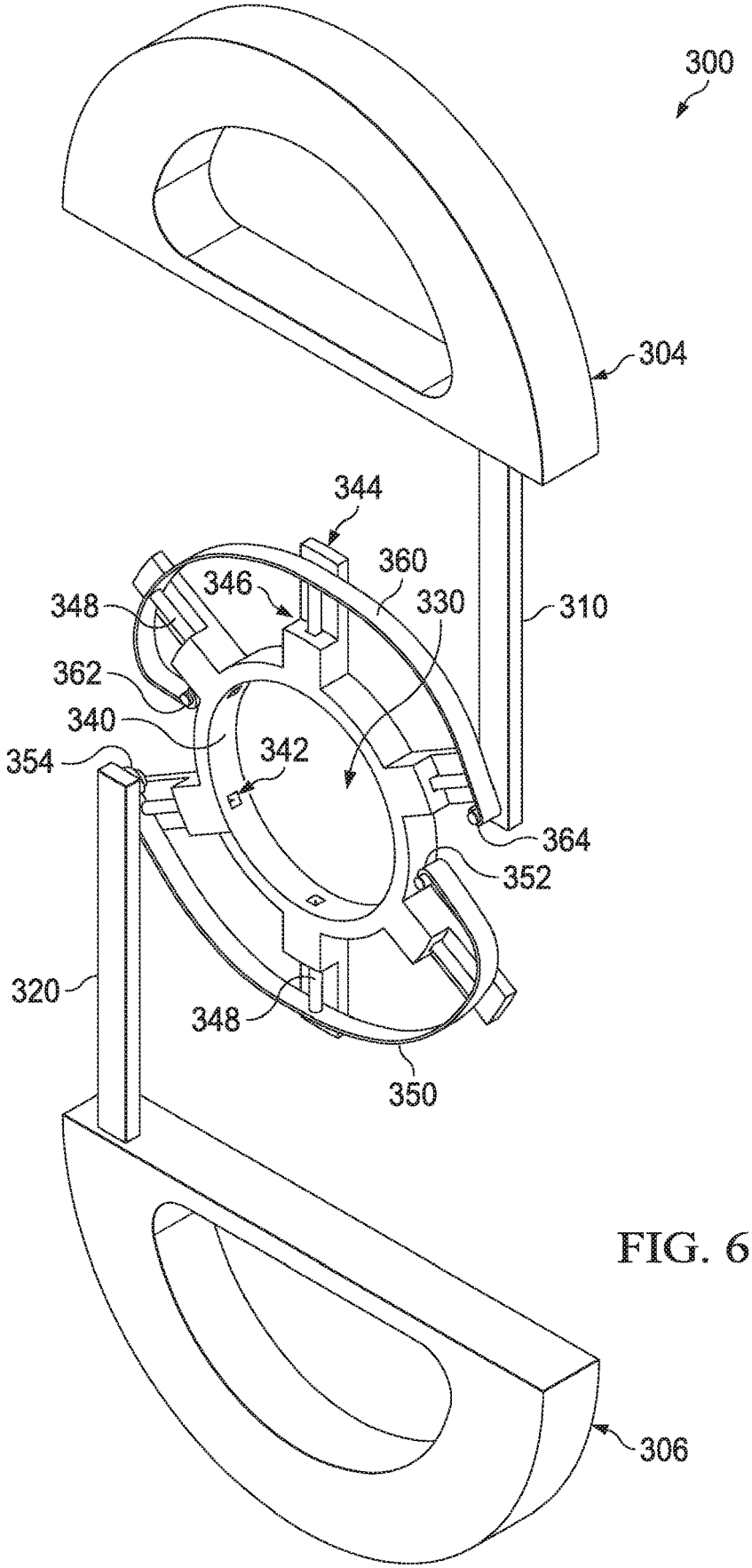
FIG. 6 shows a perspective view of the cigar piercer embodiment as shown in FIG. 5 with the housing removed and in an open position.
Figure 7:
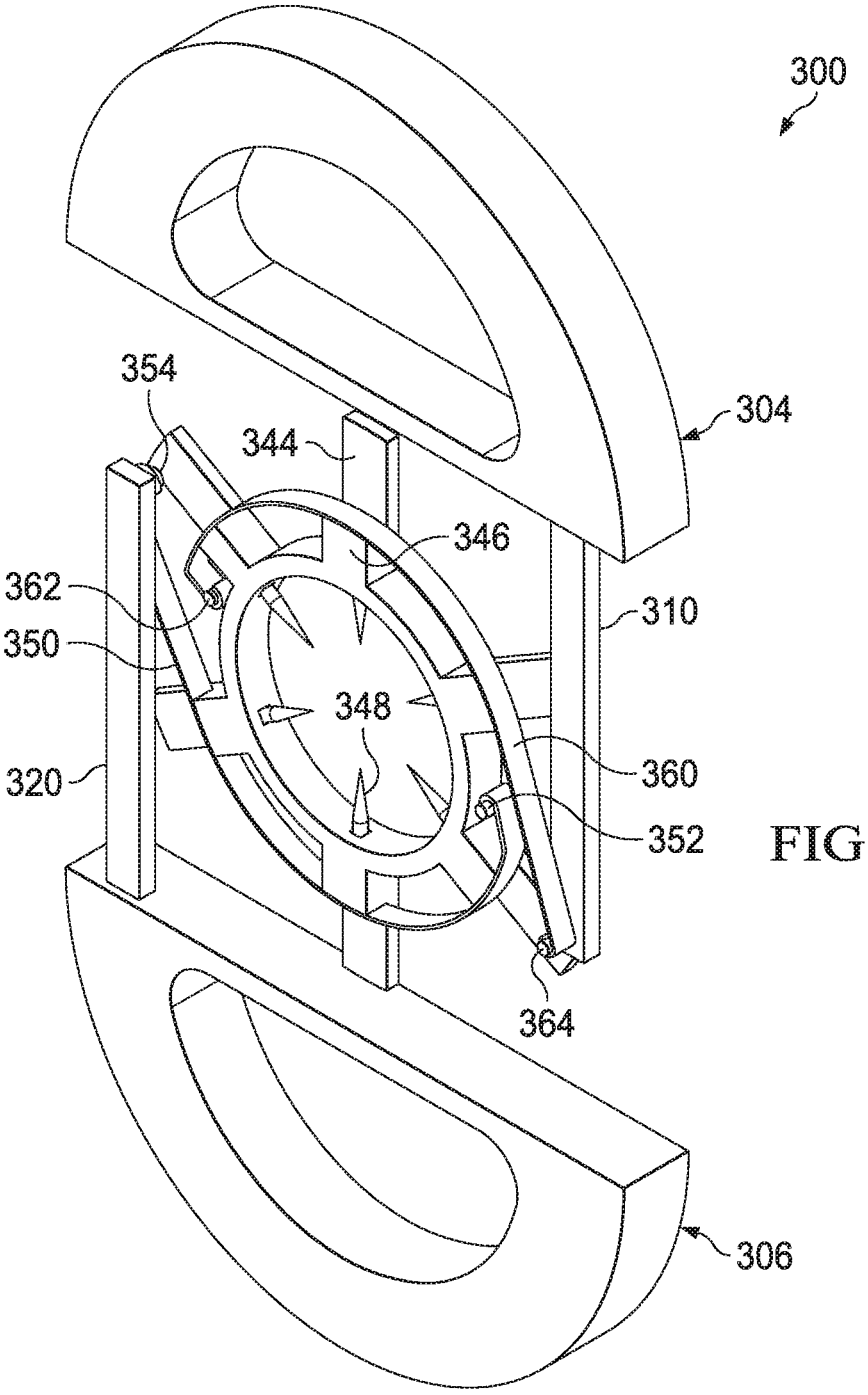
FIG. 7 shows a perspective view of the cigar piercer embodiment as shown in FIG. 5 with the housing removed and in a closed position.

FIGS. 5, 6 and 7 illustrate cigar piercer 300. FIG. 5 shows the cigar piercer 300 in an open position with a housing 302. FIGS. 6 and 7 show the cigar piercer 300 with the housing 302 removed to clearly illustrate the internal components. The cigar piercer 300 is open in FIG. 6 and closed in FIG. 7.

Cigar piercer 300 includes housing 302, first grip 304 and second grip 306. The housing 302 includes an opening 330 through the housing 302 and frame 340. The frame 340 includes multiple apertures 342 through which lances 348 pass during operation.

The first grip 304 is attached to rod 310, and the second grip 306 is attached to rod 320, both of which extend into the housing 302. In these views, the rod 310 is offset to the right and back of the housing 302, and the rod 320 is offset to the left and front of the housing 302.

As seen in FIGS. 6 and 7, the housing 302 is removed, and the frame 340 includes a lance guide 344 with a foot 346 below the outer edge of the lance guide 344. Lances 348 are pointed inward toward the opening 330 and held in place by the lance guides 344. In this embodiment, the cigar piercer 300 has six lances 348 and six lance guides 344 that are spaced at approximately 60 degrees around the opening 330 of the frame 340. The number of lances 348 and lance guides 344 and spacing between lances 348 and/or lance guides 344 may vary. For example, an embodiment may include four lances 348 with a pair of lances 348 spaced at 75 degrees on one end and a second pair of lances 348 spaced at 75 degrees on another end on frame 340.

The lances 348 each back up to one of the ribbons 350 and 360. In the embodiment shown, three lances 348 back up to ribbon 350 and three lances 348 back up to ribbon 360.

Ribbon 350 is attached on one end to fixed post 352, which connects to the housing 302, and on the other end to movable post 354, which connects to the rod 320. Similarly, ribbon 360 is attached on one end to fixed post 362, which connects to the housing 302, and on the other end to movable post 364, which connects to the rod 310. In this embodiment, the movable post 354 extends from the rod 320 toward the back of housing 302 and the movable post 364 extends from the rod 310 toward the front of housing 302. The placement and orientation of the movable posts 354 and 364, as well as the fixed posts 352 and 362, may vary to achieve the described function.

In the open state shown in FIG. 6, the lances 348 are in a default open position with the ribbons 350 and 360 behind lances 348. When the grips 304 and 306 close, the rods 310 and 320 move along an axis between the first and second grips 304 and 306 toward the opposite grip 304 or 306. This causes the ribbons 350 and 360 to tighten behind the lances 348 and move the lances 348 through the apertures 342 into the opening 330. The ribbons 350 and 360 continue to tighten until they engage each foot 346 and the corresponding lances 348 are fully extended in the opening 330.

FIG. 7 shows the cigar piercer 300 in the engaged position with the lances 348 extended through the apertures 342 into the opening 330. As illustrated, the ribbons 350 and 360 abut the feet 346 of lance guides 344.

As the ribbons 350 and 360 tighten, they rub across the back of lances 348 causing friction between the lances 348 and ribbons 350 and 360. Accordingly, it may be desirable to make the ribbons 350 and 360 from a material that minimizes friction and withstands repetitive friction, such as a metal, nylon, plastic or other material or combination of materials. For example, ribbons 350 and 360 may be a rubber band with a nylon coating.

Some embodiments may include one ribbon that loops behind all the lances 348. In such embodiments, the housing 302 and one grip 304 or 306 may be fixed together while the other grip 304 or 306 is movable. Other embodiments may include additional ribbons.

Some embodiments of the frame 340 may include ribbon guide features for the ribbons 350 and 360. For example, the foot 346 may be located between two raised portions of the lance guide 344. The corresponding raised portions can help guide the ribbon 350 or 360 and keep it behind the lance 348. Other ribbon guides may also be used to maintain alignment of the ribbons 350 and 360 behind the lances 348.

In this embodiment, the lances 348 are biased to an open position. The lances 348 may be biased based on the design of apertures 342 and internal lance guide 344. In some embodiments, a resilient material or component may be included to bias the lances 348. For example, a spring may be within the lance guide 344 and may engage both the lance 348 and lance guide 344. The spring compresses when the ribbons 350 and 360 apply pressure to the lances 348, and the spring returns to the open, default position when it expands and the ribbons 350 and 360 cease applying pressure to the lances 348.

Like earlier embodiments, the user holds the cigar piercer 300 along the cigar in the opening 330 at a desired depth for the holes. The user then squeezes the grips 304 and 306, causing the ribbons 350 and 360 to tighten and push the lances 348 inward. As the lances 348 move inward, they will apply pressure to the cigar's wrapper. As the lances 348 apply pressure, they will cause the cigar to move between the lances 348 so the lances 348 can pierce the wrapper. Once the cigar is punctured by the lances 348, the user will stop applying pressure and allow the lances 348 to retract. The user may then re-position the cigar and repeat the process if they desire more holes.

Figure 8:
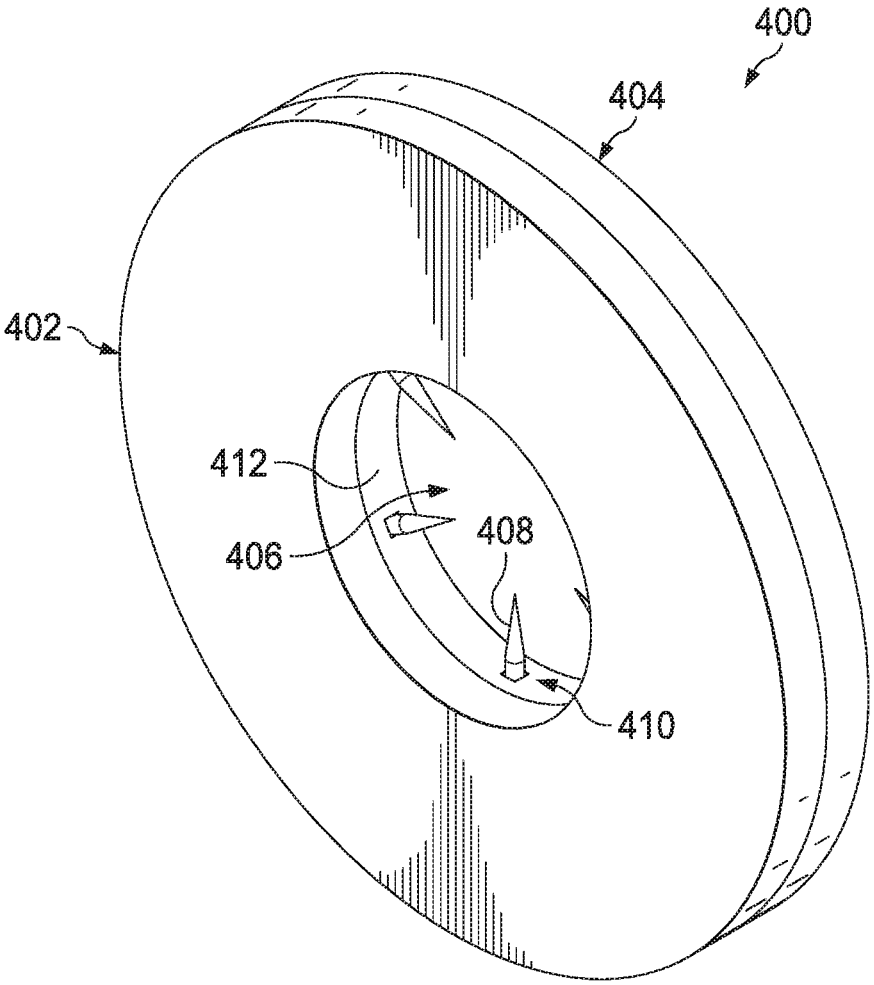
FIG. 8 shows a perspective view of another cigar piercer embodiment with protruding lances.
Figure 9:
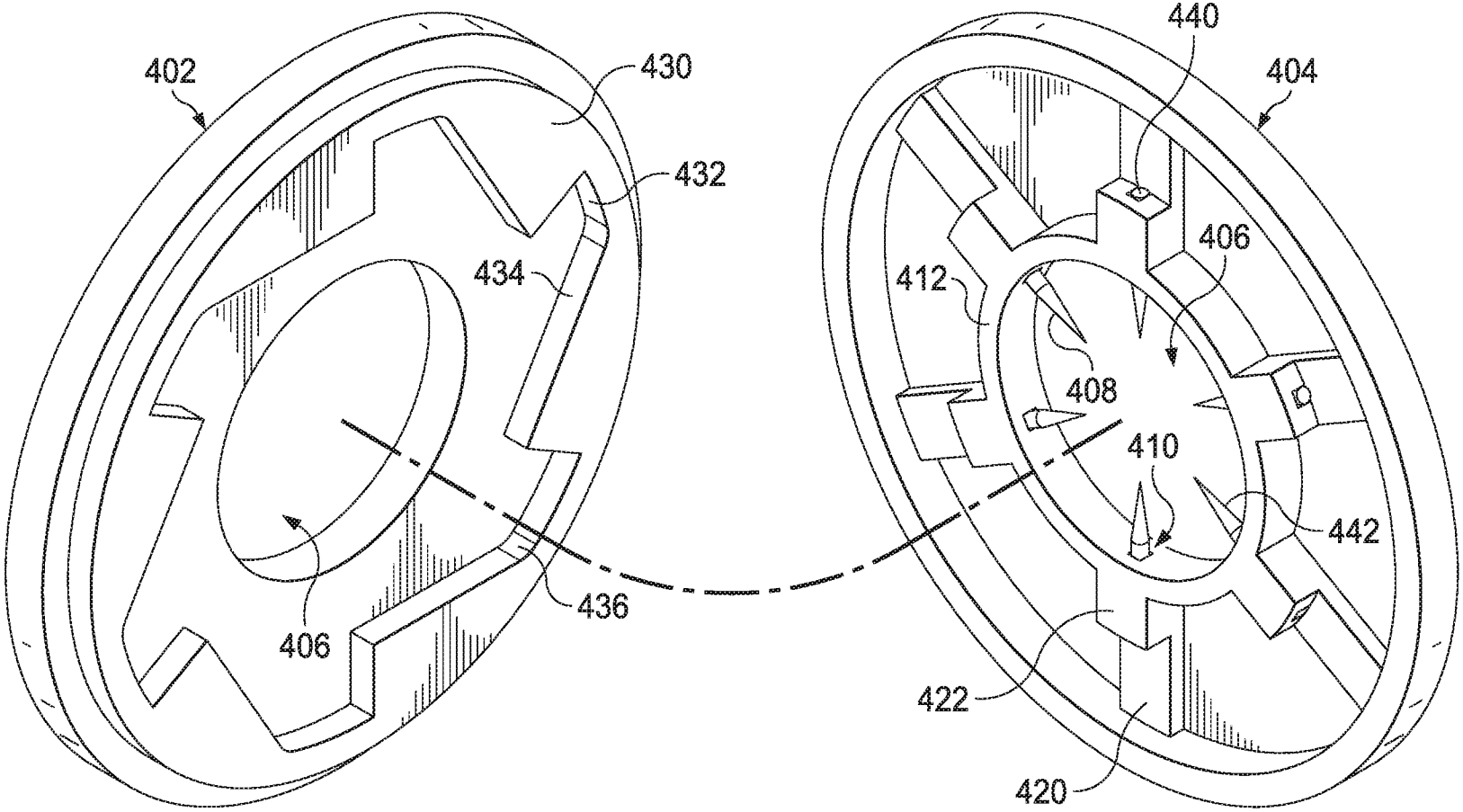
FIG. 9 shows an exploded view of the cigar piercer embodiment as shown in FIG. 8.
Figure 10:
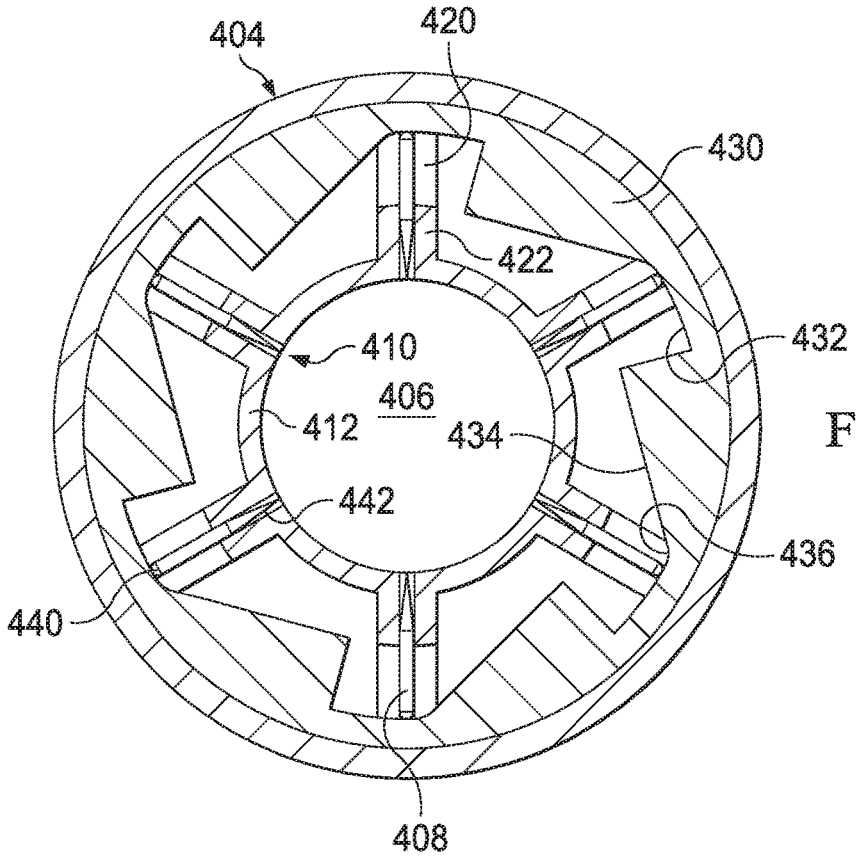
FIG. 10 shows a cross-section view of the cigar piercer embodiment as shown in FIG. 8 in a disengaged position.
Figure 11:
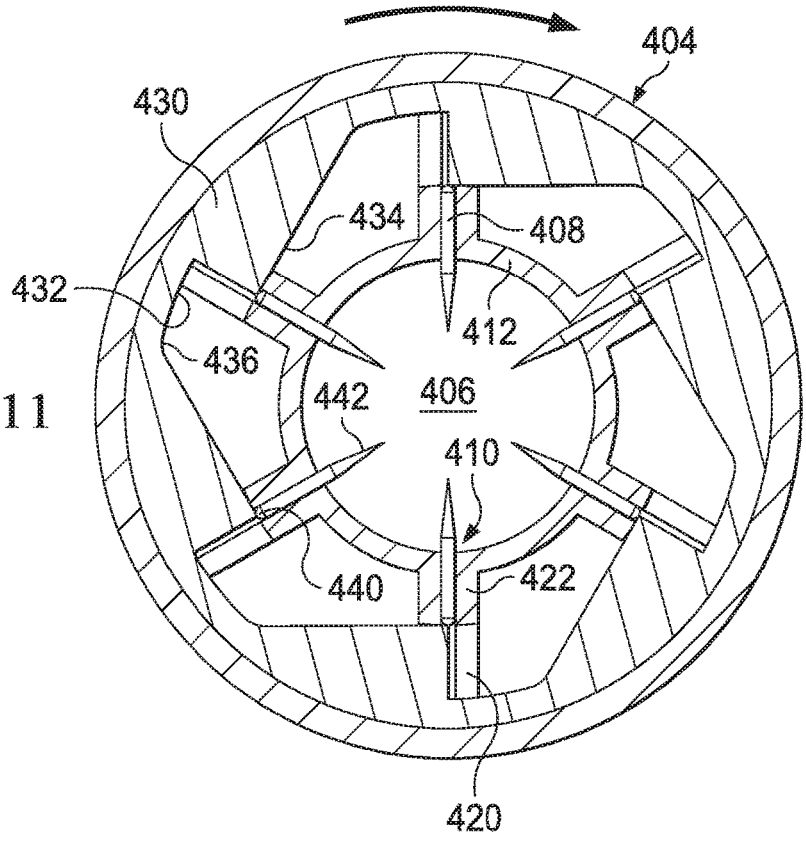
FIG. 11 shows a cross-section view of the cigar piercer embodiment as shown in FIG. 8 in an engaged position.

FIGS. 8-11 show cigar piercer 400. FIG. 8 shows a perspective view of an assembled piercer in an engaged configuration. FIG. 9 shows an expanded view in an engaged configuration. FIGS. 10 and 11 show cross-section views of the cigar piercer 400 in an open state (FIG. 10) and an engaged state (FIG. 11).

Cigar piercer 400 includes a rotation ring 402 and a lance ring 404. The two rings 402 and 404 have a rotatable connection allowing them to rotate relative to each other. The rings 402 and 404 include an opening 406 for the cigar. The interior of lance ring 404 includes a lance frame 412 with apertures 410 that allow lances 408 to pass through and into the opening 406.

The rings 402 and 404 are shown as having the same narrow width. The size, shape, texture and contour of rings 402 and 404 may vary for aesthetic and functional purposes. For example, either ring 402 or 404 may be wider and include a textured surface for a person to grip. As another example, lance ring 404 may include a finger groove to allow a user to easily hold it and a cigar, and rotation ring 402 may include an extended grip to make turning the ring easier.

In FIG. 9, the rotation ring 402 includes an extended section 430 that has a smaller diameter than the overall diameter of the rotation ring 402. The extension section has a series of wedge sections that each include a flat brace 432, a wedge 434 and a curve 436, which serves as a transition between the flat brace 432 and wedge 434.

The lance ring 404 includes the frame 412, which includes the opening surface with apertures 410 and multiple lance guides 420. Each lance guide 420 includes a foot 422. As shown, the lances 408 include a rounded base 440 on the end opposite a tip 442, which is pointed toward opening 406.

The extended section 430 fits into a channel in the lance ring 404 between the feet 422 and the exterior wall of the lance ring 404. The number of wedge sections in the extended section 430 correspond with the number of lances 408 in the cigar piercer 400. Cigar piercer 400 shows six lances 408. One skilled in the art will recognize that the number of lances 408 may vary.

In the open state, the extended section 430 is positioned with the flat braces 432 behind the lances 408. This allows the lances 408 to be fully retracted and housed within the cigar piercer 400. The bases 440 of the lances 408 are engaged with the inside edge of the flat brace 432. As the rotation ring 402 turns relative to the lance ring 404, bases 440 transition from abutting the flat braces 432 to abutting the curves 436 then the wedges 434. As the rotation ring 402 continues, the wedges 434 push the lances 408 inward toward the opening 406.

The rounded bases 440 may reduce friction between the wedge sections and lances 408. In addition, the curves 436 may smooth the transitions during rotation. Some embodiments may include additional features to reduce friction by decreasing the surface area contacting the rounded bases 440 and wedge sections. Some embodiments may add lubricating materials to reduce friction.

In this embodiment, the lances 408 are biased to an open position. The lances 408 may be biased based on the design of apertures 410 and internal lance guide 422. In some embodiments, a resilient material or component may be included to bias the lances 408. For example, a spring may be within the lance guide 422 and may engage both the lance 408 and lance guide 422. The spring compresses when the lances 408 are pushed forward through pressure from the wedges 434, and the spring expands when the lances 408 are aligned with flat bases 432, pushing the lances 408 to a default, disengaged position.

Like earlier embodiments, the user places a cigar in the opening 406 of the cigar piercer 400 at a depth for the desired placement of holes. The user holds the cigar and the lance ring 404 together and then rotates the rotation ring 402. As the rotation ring 402 rotates, the wedge sections of the rotation ring 402 push the lances 408 inward toward the opening 406. As the lances 408 move inward, they apply pressure to the cigar's wrapper. As the lances 408 apply pressure, they will position the cigar between the lances 408, and then the lances 408 will pierce the wrapper. Once the cigar is punctured by the lances 408, the user may continue to rotate the cigar or the cigar piercer 400 until the lances 408 are past the wedges 434 and align in the next flat base 432. When the lances 404 are aligned with the flat bases 432, the lances 408 retract. The user may then shift the cigar and repeat the process if they desire more holes.

Figure 12:
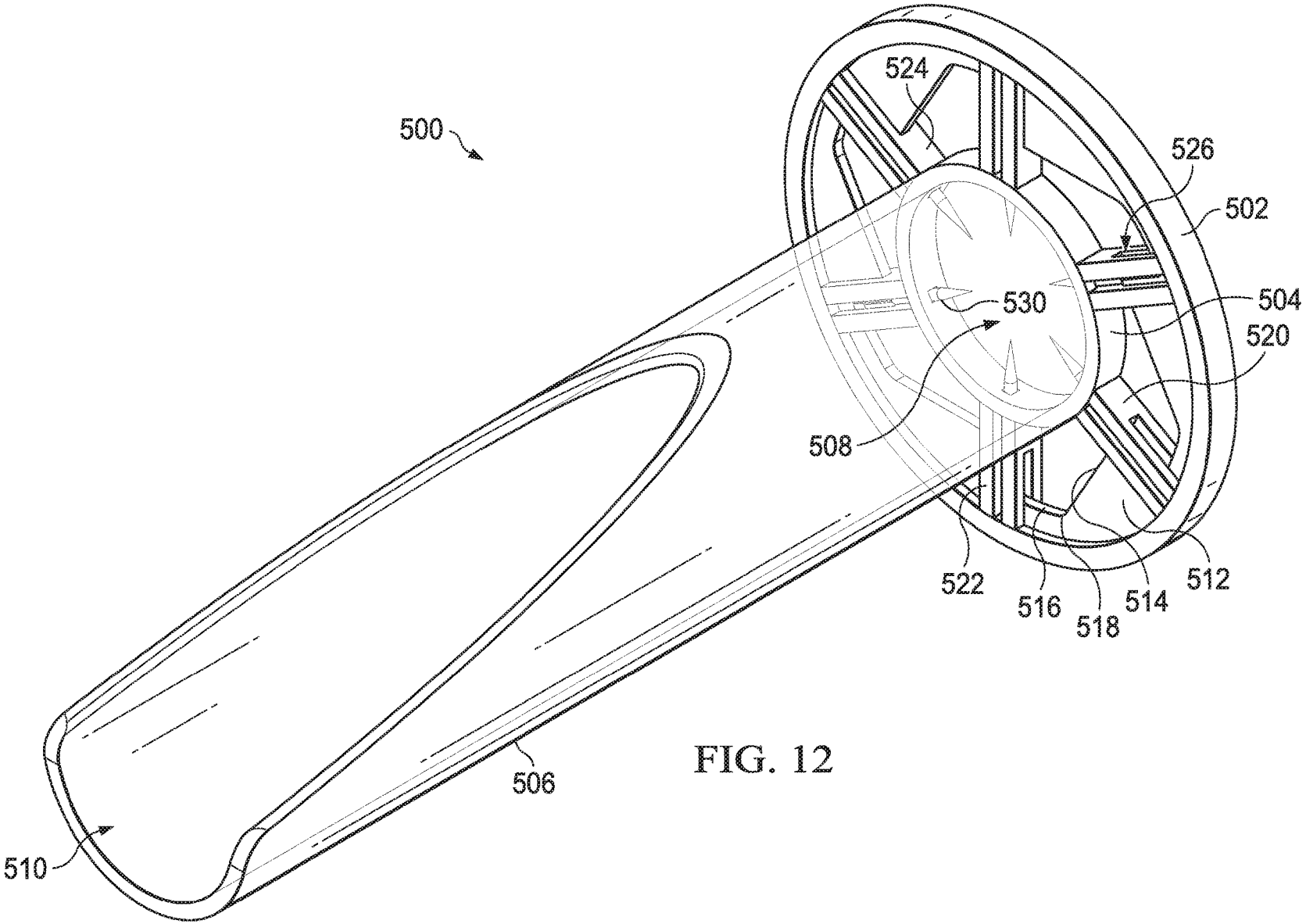
FIG. 12 shows a perspective view of another cigar piercer embodiment having a tube extension.

FIG. 12 illustrates cigar piercer 500, which is another embodiment of a rotating design. The cigar piercer 500 includes ring 502, lance frame 504 and cigar tube 506.

The ring 502 is on the external circumference of the lance frame 504 and is designed to rotate around the lance frame 504. The ring 502 includes wedge sections 512 on the inside surface. The wedge sections 512 include flat bases 516, curves 518 and wedges 514.

The lance frame 504 is open in the middle around opening 508, and includes multiple frame posts 522 extending outward from the center ring around opening 508. In this embodiment, the lance frame 504 includes six frame posts 522. Each frame post 522 includes a lance guide 524 at the base and wedge gaps 526 through the frame post 522 between the lance guide 524 and ring 502.

Lances 530 are located in each frame post 522 in this embodiment. In some embodiments, the lance frame 504 may include frame posts 522 without lances 530. For example, a cigar piercer 500 with three lances 530 may have six frame posts 522 with lances 530 in only every other frame post 522. This may provide structural or aesthetic benefits.

The wedge sections 512 are configured to pass through frame posts 522 in gaps 526 above the lance guides 524. The backs of lances 530 abut the inside surface of wedge sections 512. As the ring 502 rotates, the wedge sections 512 drive the lances 530 inward toward the opening 508.

In the open configuration, the lances 530 are retracted in lance guides 524 and abut the flat bases 516. As the ring 502 is rotated, the wedge sections 512 abutting the lances 530 transition from the flat bases 516 to the curves 518 and across the wedges 514. As the wedges 514 move behind the lances 530, they push the lances 530 into the opening 508. When the ring 502 is rotated to the point that the wedges 514 move past the frame posts 522 and lances 530, the lances 530 retract to abut the flat bases 516.

As with other embodiments, the lance frame 504 or lances 530 may include resilient members or designs to cause the lances 530 to retract. For example, the lances 530 may have a spring that compresses when the lances 530 move inward and expands outward to a default configuration when the wedge 514 is no longer pushing the lances 530 inward.

The tube 506, in this embodiment, connects to the inner ring of lance frame 504 leading to opening 508 at one end. Tube opening 510 is located at the opposite end of the tube 506. The tube 506 includes a partially open section extending from the tube opening 510 toward the lance frame 504. The open section may extend all the way to the lance frame 504. Tube 506 may not have an open section and may have an opening only at the end for insertion of a cigar. One skilled in the art will recognize that the style, shape and dimensions of the open section may vary.

During use, a person may slide a cigar into tube 506 until the cigar's head or shoulder is aligned with the lances 530 in the lance frame 504. The person can hold the cigar and tube 506 steady together in one hand while rotating ring 502. As the ring 502 rotates around the lance frame 504, the wedge sections 512 push the lances 530 into opening 508. The lances 530 engage the cigar. Then as they continue to move inward, the lances 530 puncture the cigar's wrapper creating multiple puncture holes through which the user may smoke the cigar. As with other embodiments, the lances 530 retract when the ring 502 is rotated to align the lances 530 with the flat bases 516. The user may move or rotate the cigar and puncture it again to create additional holes if desired.

The frame 504 is not enclosed within a housing in the embodiment shown, allowing the internal components to be viewed. In some embodiments, the frame 504 will be covered or enclosed within a housing.

Various materials for the cigar piercer may be used. For example, the frame 504 and ring 502 may be metal or hard plastic and the tube 506 may be a polycarbonate, plastic or glass material. The lances 530 may be made from similar hard materials with a reinforced tip.

Figure 13:
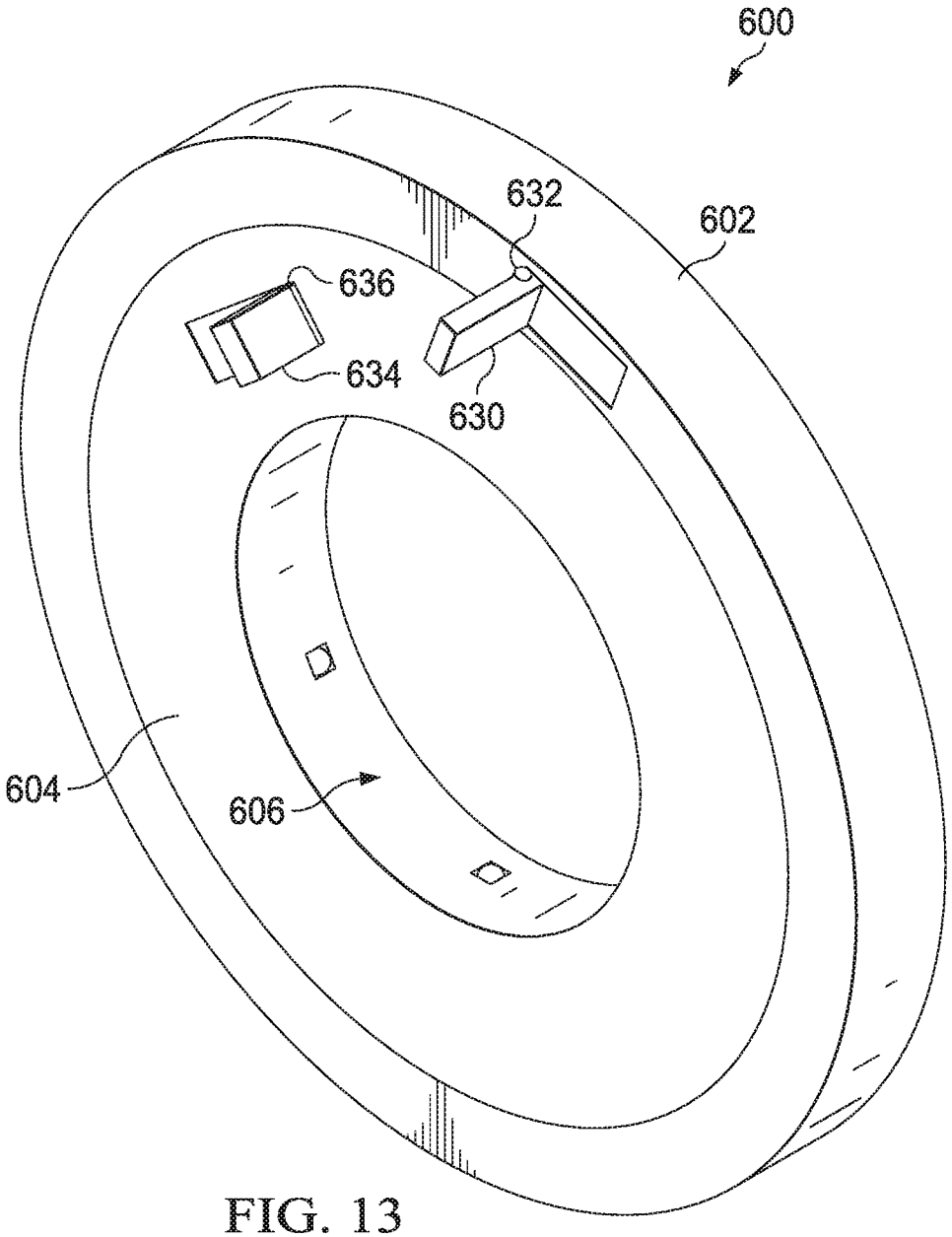
FIG. 13 shows a perspective view of another cigar piercer embodiment.
Figure 14:
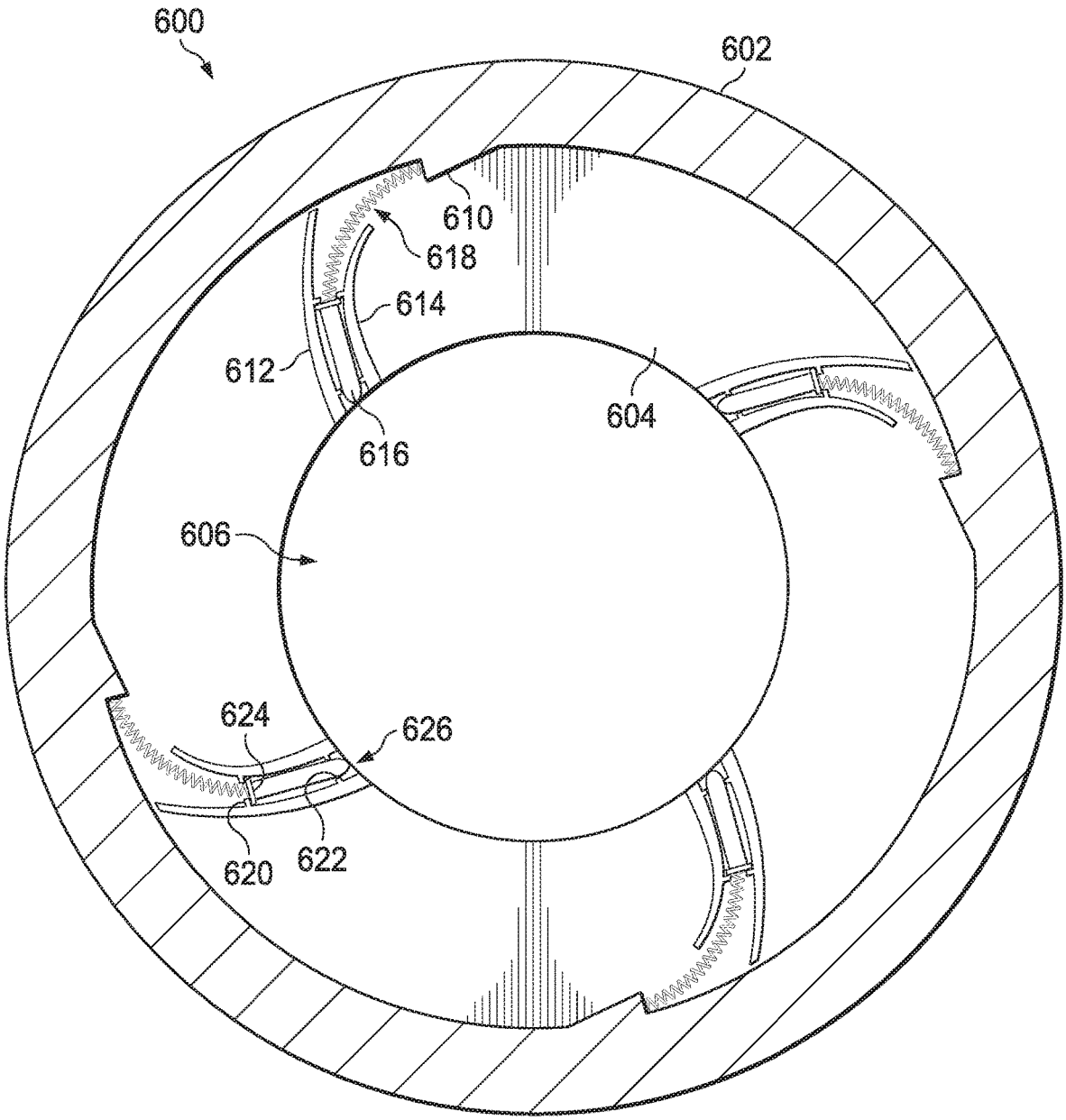
FIG. 14 shows a cross-section view of the cigar piercer embodiment as shown in FIG. 13 in a disengaged position.
Figure 15:
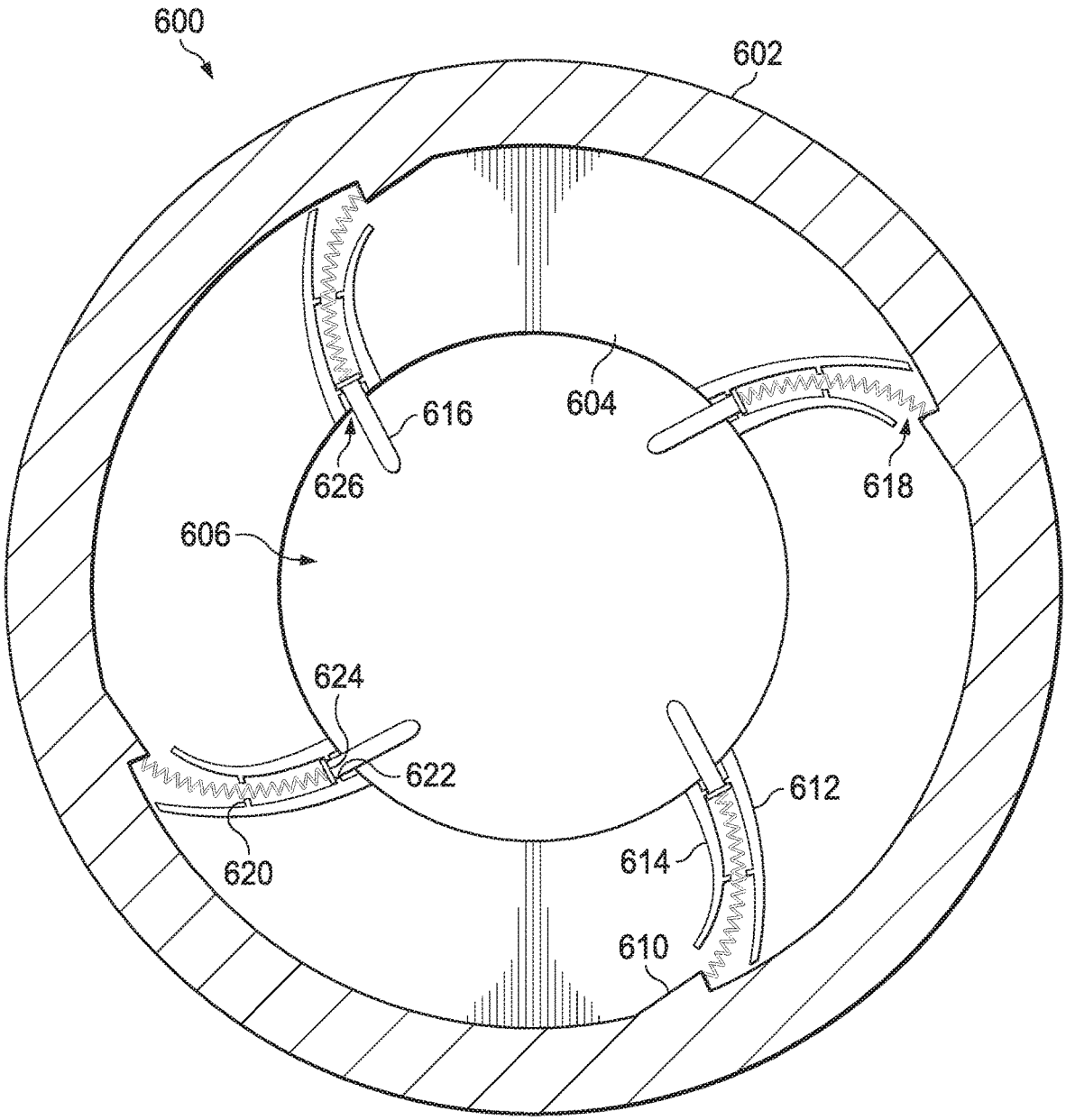
FIG. 15 shows a cross-section view of the cigar piercer embodiment as shown in FIG. 13 in an engaged position.

FIGS. 13 through 15 disclose another cigar piercer 600. FIG. 13 shows a front view of the cigar piercer 600 while FIGS. 14 and 15 show cross-section views of the cigar piercer 600 in open, engaged configurations respectively.

The cigar piercer 600 has an outer ring 602 and an inner ring 604 with an opening 606 in the middle. The inner ring 604 is fitted within the outer ring 602. The outer ring 602 includes a plurality of protrusions 610 extending within the outer edge of the inner ring 604.

The inner ring 604 includes guides 612 and 614 that hold lances 616 in-line with the aperture 626 and directed toward opening 606. The guides 612 and 614 further direct the spring 618 along a path to move the lances 616 between the disengaged and engaged positions.

Guides 612 and 614 include back stop 620 and forward stop 622. Each lance 616 includes tab 624 in at the base. The tabs 624 are designed to catch the back stops 620 and forward stops 622 within the guides 612 and 614, which create a range of movement for the lances 616. The tabs 624 may be located at other locations along the lances 616, and may be movable to allow for a wider range of motion relative to the space between the back stops 620 and forward stops 622. In addition, some embodiments may be configured to allow different lances 616 to move different distances inward.

The spring 618 connects to the protrusions 610 on one end and the lances 616 on the opposite end. Lances 616 may be designed as a cap, which allows the spring 618 to pass into the back of the lance 616 and attach internally. Alternatively, lances 616 may include a back surface to which the spring 618 will attach.

The rings 602 and 604 rotate relative to each other. From the perspective shown in FIGS. 14 and 15, the outer ring 602 rotates counter-clockwise to engage the lances 616 and clockwise to disengage the lances 616. As the outer ring 602 rotates to engage the lances 616, the protrusions 610 push the springs 618 toward the lances 616. The guides 612 and 614 ensure the springs 618 curve toward the lances 616 and the force transfers to lances 616. As the springs 616 move toward the lances 616, they push the lances 616 into opening 606 until the tabs 624 engage the forward stop 622. When the outer ring 602 is rotated back, the spring 618 expands and pulls the lances 616 out of opening 606 and causes the tabs 624 to engage the back stop 620.

When a cigar is in the opening 606, the lances 616 may engage the cigar's wrapper and springs 618 may compress further to create additional pressure to puncture the cigar's wrapper prior to engaging the tabs 624 on the forward stop 622. When the springs 618 pull back by the outer ring 602, they expand, building tension, until they have sufficient pull on the lances 616 to remove them from the cigar's wrapper.

Some embodiments may include another spring or other resilient component between the tabs 624 and the forward stop 622 to create a back pressure on the lances 616 to further bias them to the retracted position. Such a design may be implemented in any embodiment disclosed herein to bias or retract lances.

Cigar piercer 600 shows four lances 616 spaced around the circumference. Some embodiments may include more or less lances 616 and may have varied spacing. For example, a cigar piercer 600 may include three lances 616 that are all located within a single 160 degree range. As with other embodiments, a user may, after initially piercing a cigar, re-position cigar piercer 600 to pierce the cigar again and create additional holes.

FIG. 13 also shows outer grip 630 attached to the outer ring 602 and an inner grip 634 attached to the inner ring 604. The grips 630 and 634 are connected to the rings 602 and 604 by hinge 632 and 636. The hinges 632 and 636 allow the grips 630 and 634 to change from an open position to a closed position. For example, the grips 630 and 634 may be extended when in an open position, and the grips 630 and 634 may be folded against the surface of the corresponding ring 602 or 604 when in a closed position. In some embodiments, the rings 602 and 604 may each include a recess or depression that the grips 630 and 634 will fold into when in a closed position.

The grips 630 and 634 allow a user to operate the cigar piercer 600 by moving the grips 630 and 634 toward each other, causing the outer ring 602 to rotate relative to the inner ring 604. The grips 630 and 634 may be configured for a user to operate the cigar piercer 600 with one hand while holding the cigar in their other hand.

The extended position is configured to open wide enough to provide a surface for the user to apply pressure when operating the cigar piercer 600. The extended position may be substantially perpendicular to the surface of the rings 602 and 604 in some embodiments.

Some embodiments may include grips that extend outward from the outer ring 602 in the same plane as the rings 602 and 604, with one grip attached to the outer ring 602 by a hinge and the second grip attached to the inner ring 604 by a hinge. In another embodiment, the inner ring 604 may be attached to a tube similar to the tube shown in FIG. 12, which a user may grip with the cigar during operation. One skilled in the art will recognize that additional grip designs and features may be implemented in the cigar piercers taught in this application.

The invention being thus described and further described in the claims, it will be obvious that the same may be varied in many ways. Such variations are not to be regarded as a departure from the spirit and scope of the invention, and all such modifications as would be obvious to one skilled in the art are intended to be included within the scope of the apparatuses and methods described.

The invention claimed is:

1. A cigar piercer configured to create multiple punctures in a cigar comprising:

a housing having an opening;

a first frame attached to a first grip;

a second frame attached to a second grip;

a plurality of lances, each having a tip on one end, wherein the plurality of lances are distributed on the first frame and the second frame and are movable between a first position and a second position;

wherein the first grip and the second grip are used to move the first frame, the second frame and the plurality of lances between the first position and the second position;

wherein the plurality of lances are configured to move into the opening and puncture the cigar during operation; and wherein the housing includes lance guides around the opening and the plurality of lances each pass through a corresponding one of the lance guides when enteringthe opening.

2. The cigar piercer of claim 1, wherein the first grip and the first frame are aligned on a side of the housing that is opposite from the second grip and the second frame.

3. The cigar piercer of claim 1, wherein the plurality of lances includes at least two of the lances on both of the first frame and the second frame, wherein the lances are aligned around a ring of the cigar.

4. The cigar piercer of claim 1, wherein the plurality of lances are in an offset configuration, wherein all the plurality of lances are spaced to fit within a ring of the cigar, and during operation create the multiple punctures in the ring of the cigar through which a user inhales smoke.

5. The cigar piercer of claim 1, including a first resilient member attached to the housing and the first frame, and a second resilient member attached to the housing and the second frame, wherein the first resilient member and the second resilient member hold the plurality of lances in a first position and allow the plurality of lances to move into the second position when pressure is applied to the first grip and the second grip.

6. A cigar piercer configured to create multiple punctures in a cigar comprising:

a housing having an opening, which fits around at least a shoulder of the cigar, wherein the housing includes lance guides around the opening;

a first frame attached to a first grip, which extends from the housing and includes a first finger opening;

a second frame attached to a second grip, which extends from the housing and includes a second finger opening; and a plurality of lances, each having a tip on one end, wherein the plurality of lances are distributed on the first frame and the second frame and are movable between a first position and a second position;

wherein the first grip and the second grip are used to move the first frame, the second frame and the plurality of lances between the first position and the second position; and wherein the plurality of lances are configured to each pass through a corresponding one of the lance guides and move into the opening.

7. The cigar piercer of claim 6, wherein the first grip and the first frame are aligned on a side of the housing that is opposite from the second grip and the second frame.

8. The cigar piercer of claim 6, wherein the plurality of lances includes at least two of the lances on both of the first frame and the second frame, wherein the lances are aligned around a ring of the cigar.

9. The cigar piercer of claim 8, wherein the at least two lances are in an offset configuration along both of the first frame and the second frame.

10. The cigar piercer of claim 6, wherein the plurality of lances are in an offset configuration, wherein all the plurality of lances are spaced to fit within a ring of the cigar, and during operation create the multiple punctures in the ring of the cigar through which a user draws in smoke.

11. The cigar piercer of claim 6, including a first resilient member attached to the housing and the first frame, and a second resilient member attached to the housing and the second frame, wherein the first resilient member and the second resilient member hold the plurality of lances in a first position and allow the plurality of lances to move into the second position when pressure is applied to the first grip and the second grip.

12. A method for creating multiple punctures in a cigar comprising:

positioning a cigar piercer around a shoulder or a cap of the cigar, wherein the cigar piercer comprises a housing having an opening into which the cigar fits and lance guides around the opening, a first frame attached to a first grip, which extends from the housing and includes a first finger opening, a second frame attached to a second grip, which extends from the housing and includes a second finger opening, and a plurality of lances, each having a tip on one end, wherein the plurality of lances are distributed on the first frame and the second frame and are movable between a first position and a second position;

moving the first grip and the second grip toward each other, which causes the first frame, the second frame and the plurality of lances to move from the first position to the second position wherein the plurality of lances each enter the opening and pass through a corresponding one of the lance guides, wherein the lances puncture the cigar when moving into the second position;

removing the plurality of lances from the cigar and into the first position;

removing the cigar from the cigar piercer, wherein the cigar has the multiple punctures in the shoulder or the cap through which smoke may be drawn by a user.

* * * * *